US007712954B2

(12) United States Patent
Bourban et al.

(10) Patent No.: US 7,712,954 B2
(45) Date of Patent: May 11, 2010

(54) DEVICE FOR ASSEMBLING A TOUCH-TYPE CRYSTAL ON A CASE

(75) Inventors: Steve Bourban, Ecublens (CH); Rudolf Dinger, Saint-Aubin (CH); Gilles Derriey, Morteau (FR); Christian Verdon, Boussens (CH); Giancarlo Poli, Les Geneveys-sur-Coffrane (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 11/423,539

(22) Filed: Jun. 12, 2006

(65) Prior Publication Data

US 2006/0280040 A1 Dec. 14, 2006

(30) Foreign Application Priority Data

Jun. 14, 2005 (EP) ..... 05012733
Mar. 29, 2006 (CH) ..... 0507/06

(51) Int. Cl.
*G04B 39/00* (2006.01)
*G04B 37/00* (2006.01)

(52) U.S. Cl. ..... 368/296; 368/294

(58) Field of Classification Search ..... 368/294–296
See application file for complete search history.

(56) References Cited

U.S. PATENT DOCUMENTS 2,716,829 A * 9/1955 Huguenin et al. ..... 368/234
3,911,670 A 10/1975 Hofer
4,435,090 A * 3/1984 Jaccard ..... 368/32
4,474,482 A * 10/1984 Gogniat ..... 368/296
4,623,262 A 11/1986 Gogniat et al.
7,167,689 B2 * 1/2007 Martin et al. ..... 368/296
2001/0014618 A1 8/2001 Martin et al.
2002/0184920 A1 12/2002 Fossaluzza
2006/0062971 A1 * 3/2006 Bourban et al. ..... 428/172
2006/0280041 A1 * 12/2006 Verdon et al. ..... 368/296

FOREIGN PATENT DOCUMENTS

AU 769373 B2 3/2001
EP 1 079 325 A1 2/2001
EP 1 122 620 A1 8/2001
EP 1 207 439 A1 5/2002
EP 1 457 865 A1 9/2004
FR 2 750 419 1/1998

OTHER PUBLICATIONS

European Search Report issued in corresponding application No. EP 05 01 2733 completed Dec. 22, 2005.
Australian Search Report issued in Singapore Patent Application No. SG 200603151-2 completed Jan. 3, 2007 and mailed Jan. 16, 2007.
Berner, G.-A., Illustrated Professional Dictionary of Horology I + II, Switzerland, 2002, pp. 113, 529-531, 653, 1113-1135 (Exhibit B).

* cited by examiner

*Primary Examiner*—Renee S Luebke
*Assistant Examiner*—Sean Kayes
(74) *Attorney, Agent, or Firm*—Griffin & Szipl, P.C.

(57) ABSTRACT

The crystal (10), in the inner surface of which contact zones (17) are structured, includes close to its edge a hollow (14) machined in one of its faces (11, 12) or a groove (25) machined in its thickness and provided with an enamel deposition (20) for concealing said contact zones (17) after bonding.

15 Claims, 2 Drawing Sheets

DEVICE FOR ASSEMBLING A TOUCH-TYPE CRYSTAL ON A CASE

This application claims priority from European Patent Application No. 05012733.1 filed Jun. 14, 2005 and Swiss Patent Application No. 00507/06 filed Mar. 29, 2006, the entire disclosure of which is incorporated herein by reference.

FIELD OF THE INVENTION

The present invention concerns a device for assembling a tactile or touch type crystal on a case, wherein contact zones, located close to one edge of the crystal, for connecting electrodes structured on the inner face of the crystal, to an electronic module contained in the case, are hidden and electrically insulated.

The invention will be more specifically illustrated by a wristwatch having a tactile crystal extending to the outer edge of the middle part.

BACKGROUND OF THE INVENTION

The most common way of assembling a tactile crystal, generally made of sapphire, on a wristwatch case is explained hereinafter with reference to FIG. 1 and to the schematic cross-section of FIG. 2, in which the contrasts and thicknesses have been greatly exaggerated for better comprehension.

The wristwatch shown includes, in a known manner, a case 1 formed of a middle part 3 closed on its bottom part by a back cover 5 and on its top part by a crystal 10 delimiting a compartment 7. Compartment 7 is for housing a watch movement 8 for the display of timer data on a dial 6. In the example shown, the display is an analogue display by means of hands for the hours 6*a*, minutes 6*b* and seconds 6*c*.

It can also be seen that the bottom face 11 of crystal 10 includes five electrodes 15 forming, for example, capacitive sensors, the electrodes 15 each being connected via conductive paths 16 to contact zones 17 made close to the edge 12 of crystal 10. The conductive network 15, 16, 17 is made in a known manner by structuring a transparent conductive oxide, such as indium and tin oxide (ITO), deposited for example by vapour deposition and having a thickness comprised between 25 and 75 nm. Electrodes 15 and conductive paths 16 can be made practically invisible by depositing dielectric layers in the spaces comprised between the electrodes 15 and paths 16, as disclosed for example in EP Patent No. 1 457 865. However, contact zones 17, which are placed in contact with a connector 19 passing through an insulating connector ring 2 and connecting an electronic module 9, capable of detecting the presence of a finger above one electrode 15 and of sending a control signal to movement 8, are much more visible.

When crystal 10 is assembled on case 1 by means of a bezel 13 secured to the middle part, bezel 13 need only be given sufficient width to conceal contact zones 17.

However, there exist cases, particularly for wristwatches, wherein crystal 10 extends to the outer edge of middle part 3. Crystal 10 is assembled for example via bonding on the shoulder of the middle part 3 or on an insulating connector ring 2. In order to conceal the adhesive joint, metallising has to be carried out by depositing at least one very thin anchorage layer, generally by chromium evaporation, and possibly other metals or alloys, close to the edge of the crystal, in order to try to harmonise the hue of the middle part shoulder seen through the crystal with that of the rest of the middle part. For tactile crystals, there is thus a significant risk of short-circuiting two neighbouring contact zones 17, or of creating stray capacitance.

SUMMARY OF THE INVENTION

It is thus an object of the present invention to overcome the drawbacks of the aforecited prior art by providing a tactile crystal that can be assembled, for example by bonding, to the shoulder of the aperture of a case while concealing the contact zones, without any risk of causing short-circuits The invention therefore concerns a device for assembling a tactile crystal, made of a transparent material, resistant to temperatures higher than 500° C., to the shoulder of the aperture of a case, such as a wristwatch case. The tactile crystal includes on its inner face, in a known manner, a conductive network comprising transparent electrodes connected by conductive paths to generally grouped contact zones to form a connection area, opposite the ends of connectors connected to an electronic module housed in a compartment of the case. The tactile crystal is characterized in that it includes, close to its edge, a deposition of enamel of which at least one part of the surface conceals the electrode connection area.

The transparent material resistant to temperatures higher than 500° C. can be a mono or polycrystalline material, for example quartz, spinelle or corundum, particularly sapphire. An amorphous material may also be used, such as a mineral glass, provided its softening point is higher than the temperature necessary to carry out the enamel deposition.

According to a first embodiment, the enamel deposition has the shape of a tape following the inner contour of the crystal and whose width is at least equal to the width of the connection area.

It is also desirable for the conductive network to be structured on a surface that has no discontinuities.

For this purpose a hollow is machined in the inner face of the crystal, the contour of which at least substantially corresponds to that of the connection area, enamel is deposited in one or several steps until a thickness, slightly greater than the depth of the hollow is achieved, then polishing is carried out to make the surface level of the enamel the same as that of the crystal in order to structure the conductive network.

According to a second embodiment, the enamel deposition is carried out in a groove formed in the thickness of the crystal, the depth of the groove being at least equal to the width of the connection area.

BRIEF DESCRIPTION OF THE DRAWINGS

Other features and advantages of the present invention will appear in the following description illustrated by a wristwatch given by way of illustrative and non-limiting example, with reference to the annexed drawings, in which.

DETAILED DESCRIPTION OF THE INVENTION

Figure 1:
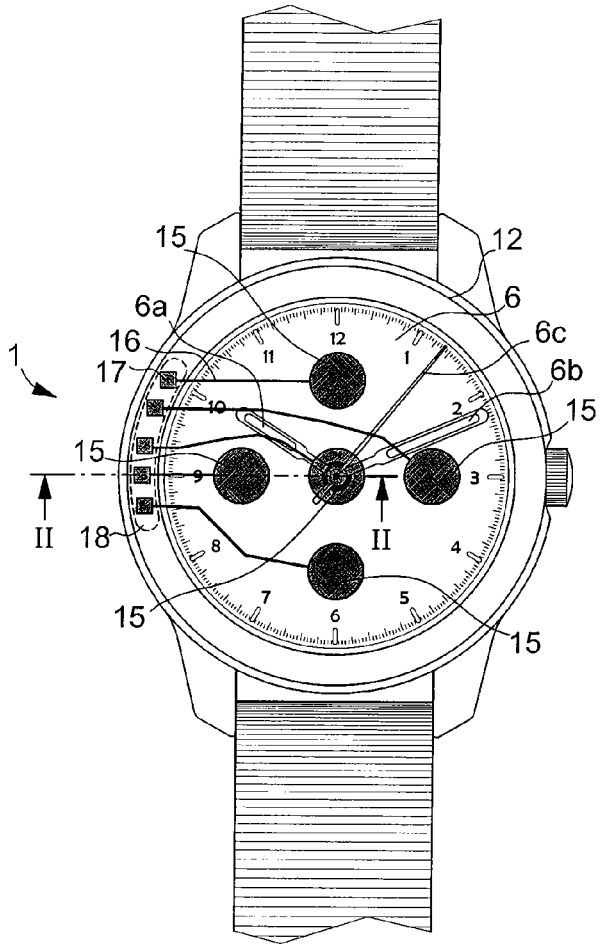
FIG. 1 shows a top view of a wristwatch with a tactile crystal.
Figure 2:
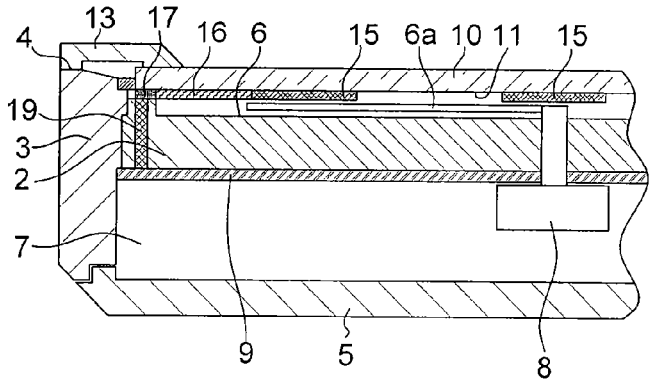
Fig. 2 ( PRIOR ART )
FIG. 2 corresponds to a semi-cross-section along the line II-II of FIG. 1 for a wristwatch according to the prior art.

FIGS. 1 and 2 have already been described for indicating the closest prior art, and only FIG. 4 and the following Figures will be described hereinafter, in which the same references are used to designate the same elements of the wristwatch.

Figure 3:
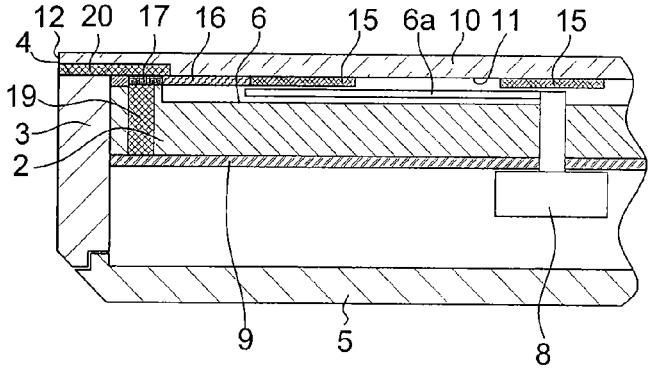
FIG. 3 shows a semi-cross-section along the line II-II of FIG. 1 for a wristwatch according to the invention.

FIG. 3, which is a semi-cross-section along line II-II of FIG. 1 passing through two sensors 15, a conductive path 16 and a contact zone 17, shows that edge 12 of crystal 10 extends to the outer surface of middle part 3 and that the crystal 10 is not held by means of a bezel secured to the middle part 3. The inner face 11 of crystal 10 includes, close to its edge, an enamel deposition 20 which extends above the entire connection area 18 (shown in dotted lines in FIG. 1) where the five contact zones 17 of the five electrodes 15 are grouped.

It is possible to carry out this enamel deposition solely in the connection area 18 and to metallise the remaining part of the shoulder of the case where there is no risk of short-circuiting, then to assemble the crystal, for example by bonding. This method requires an additional step, which increases the costs, and it can be difficult, or impossible to find the same hue and the same tone for the enamel and the metallising, which is inconvenient when aesthetic appearance is also important. This is why it is preferable to carry out the enamel deposition in the form of a continuous tape that goes all around crystal 10 and whose width is at least equal to the width of connection area 18, such that the same hue is observed over the entire periphery of the case.

Depending upon the type of case, it is also possible to mount crystal 10 by snap fitting with the insertion of a synthetic sealing gasket between the crystal and the case.

Figure 4:
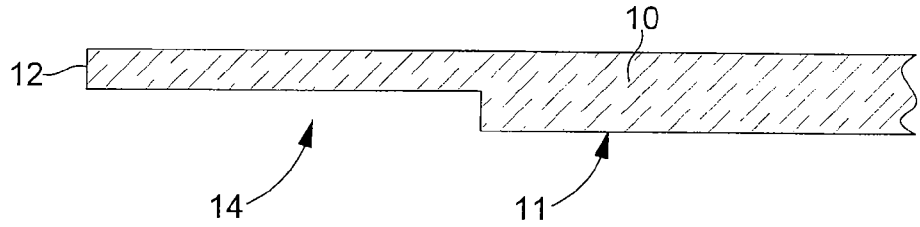
FIGS. 4 to 6 show the various steps of a method for making a tactile crystal according to the invention, according to a first embodiment.
Figure 6:
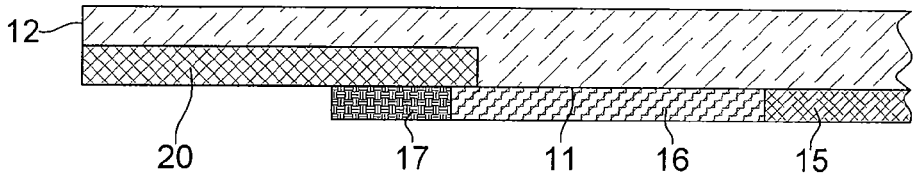

With reference now to FIGS. 4 and 6, a method will be described hereinafter for making a tactile crystal according to the invention, the material forming the crystal being sapphire by way of example.

In a first step shown in FIG. 4, a hollow 14 is made close to edge 12 of crystal 10 by means of a diamond grinding-wheel over a depth comprised between 0.1 mm and 0.5 mm, depending upon the thickness of crystal 10.

Figure 5:
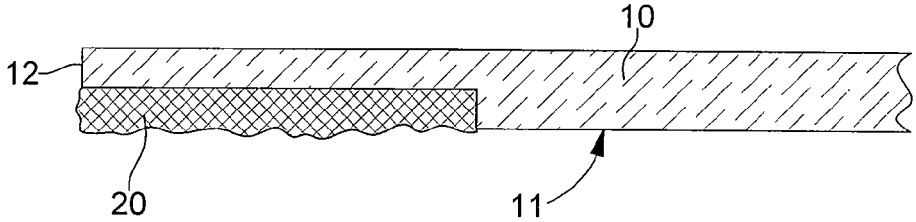

In a second step shown in FIG. 5, an enamel deposition 20 is carried out, in one or several steps, via known soaking, spraying, buffing or silk printing techniques, each step being followed by baking, until the enamel slightly projects above the inner face of the crystal.

According to a step that is not shown, the entire inner surface of the crystal is polished so as to remove any discontinuities between the enamel layer and the rest of the crystal.

In a last step, shown in FIG. 6, the conductive network 15, 16, 17 is structured with a transparent conductive oxide, such as indium and tin oxide (ITO). This step will not be described further since it is well known to those skilled in the art. Crystal 10 can then be assembled on shoulder 4 of the middle part with the insertion of an adhesive joint, then pressed.

Figure 7:
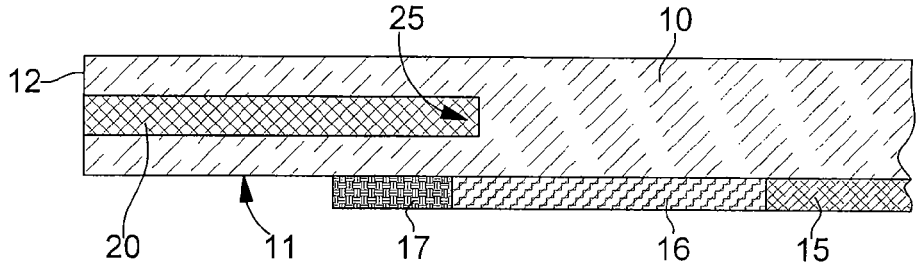
FIG. 7 shows a tactile crystal according to a second embodiment.

With reference now to FIG. 7, a second embodiment is shown. As can be seen, edge 12 of crystal 10 is machined to obtain a groove 25 in which the enamel layer 20 is formed. This embodiment has the advantage of making the porosities in the enamel mass invisible, facilitating the machining and polishing operations including at the aperture of groove 25. This embodiment also allows much easier polishing of the surface where contact zones 17 have to be structured, without any risk of creating zones of discontinuity able to have a detrimental effect on conductive paths 16 connecting sensors 15 and contact zones 17.

In the preceding description, the invention was illustrated by a flat tactile crystal, but it is clear that the invention also applies to any convex crystal.

What is claimed is:

1. A device including a display visible through a tactile crystal, wherein the crystal is assembled on a shoulder of an aperture of a case without employing a bezel and the crystal extends to an outer surface of the case, wherein the crystal is made of a transparent material resistant to temperatures higher than 500° C., and the crystal includes on an inner face thereof transparent electrodes forming sensors, wherein the transparent electrodes are connected by conductive paths to contact zones located in a connection area close to an edge of the crystal opposite ends of connectors of an electronic module contained in a compartment of the case, wherein a portion of the edge of the crystal is formed by a deposition of enamel, and at least one part of the surface of the enamel deposition conceals the connection area so that assembly of the crystal on the case is achieved without covering the crystal by a bezel.

2. The device according to claim 1, wherein the enamel deposition is carried out in a hollow machined in the inner face of the crystal at least at the connection area.

3. The device according to claim 1, wherein the enamel deposition is carried out in a groove machined in a thickness of the crystal at least at the connection area.

4. The device according to claim 1, wherein the transparent material forming the crystal is a monocrystalline material or polycrystalline material.

5. The device according to claim 4, wherein the material forming the crystal is sapphire.

6. The device according to claim 4, wherein the transparent material forming the crystal is selected from the group consisting of quartz, spinelle and corundum.

7. The device according to claim 1, wherein the transparent material forming the crystal is an amorphous material.

8. The device according to claim 7, wherein the transparent material forming the crystal is a mineral glass.

9. The device according to claim 1, wherein a hue of the enamel layer matches that of the case.

10. The device according to claim 1, wherein the tactile crystal is assembled on the shoulder of the case by bonding.

11. The device according to claim 1, wherein the compartment of the case further contains a watch movement and a dial to form a timepiece with at least partially tactile control.

12. A method of manufacturing a tactile crystal of a transparent material resistant to temperatures higher than 500° C., wherein the tactile crystal includes on an inner face thereof a conductive network including electrodes, conductive paths and contact zones forming a connection area, the method including the steps of:

(a) machining a hollow in an inner face of a crystal, or a groove in a thickness thereof, whose contour at least substantially corresponds to that of a connection area;

(b) forming an enamel deposition in the hollow or in the groove;

(c) polishing a surface of the enamel deposition and a non-enamelled surface of the crystal to place each at the same level; and (d) structuring a conductive network on an inner enamelled surface and non-enamelled surface of the crystal so that the tactile crystal is configured for assembling to a shoulder of an aperture of a case without employing a bezel.

13. The device according to claim 1, wherein the conductive paths are transparent and the contact zones are transparent.

14. The method according to claim 12, wherein the conductive network is transparent.

15. The method according to claim 14, wherein the electrodes are transparent, the conductive paths are transparent and the contact zones are transparent.

* * * * *